United States Patent [19]

Shiau

[11] Patent Number: 4,940,860

[45] Date of Patent: Jul. 10, 1990

[54] WATERPROOF SWITCHING DEVICE

[76] Inventor: Shoei-Shuh Shiau, No. 10, Alley 1, Lane 551, Sec. 1, Wan-Shou Rd., Guei-Shan Hsiang, Taoyuan Hsien, Taiwan

[21] Appl. No.: 376,849

[22] Filed: Jul. 7, 1989

[51] Int. Cl.[5] ..... F21V 23/04; H01H 9/04

[52] U.S. Cl. ..... 200/60; 200/302.2

[58] Field of Search ..... 200/60, 302.2; 362/187, 362/205

[56] References Cited

U.S. PATENT DOCUMENTS 3,924,116 12/1975 Brindley ..... 200/60 X
3,924,117 12/1975 Brindley ..... 200/302.2 X
4,286,311 8/1981 Maglica ..... 362/205

*Primary Examiner*—J. R. Scott
*Attorney, Agent, or Firm*—Arnold, White & Durkee

[57] ABSTRACT

The present invention relates to a waterproof switching device for a portable electric appliance with a hollow body. The switching device comprises a switching body, a sealing member, a slideable button and a coupling ring, wherein the switching body includes two parts, the profiles of which are complementarily to each other, the switching body having a dimension which is slightly larger than that of the circumferential shell of the cavity of the hollow body of the portable electric appliance. The profile of the switching body is slightly converging in a longitudinal direction relative to an axis thereof. By virtue of forcing the converged end portion into the cavity of the hollow body, the switching body will be tightly snapped therein. A coupling ring may further be interposed between the switching body and the hollow body to strengthen the engagement of the switching body with the hollow body. With a more tight engagement between the switching body and the hollow body, the sealing member which is interposed therebetween can provide a better sealing to prevent the interior of the portable electric appliance from being wetted.

11 Claims, 2 Drawing Sheets

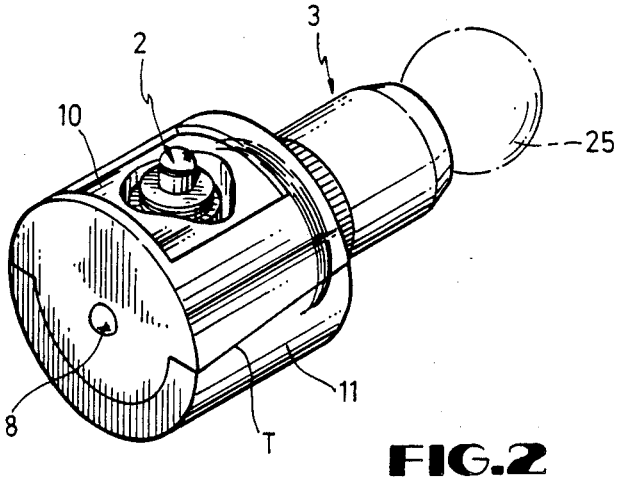
FIG.2
FIG.3
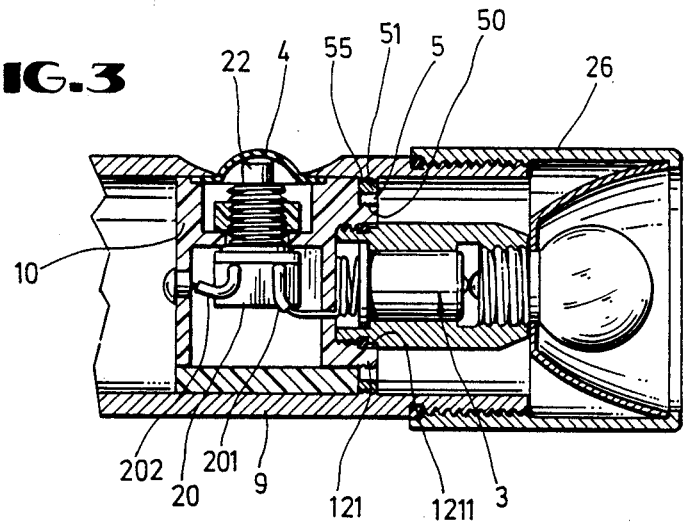

WATERPROOF SWITCHING DEVICE

BACKGROUND OF THE INVENTION

This invention relates to a waterproof switching device, and particularly to a waterproof switching device for a portable electric appliance.

In order to prevent the possible malfunction of a portable electrical appliance, e.g. a flashlight, it is crucial that the constituted parts involved in the establishment of an electrical circuit of the flashlight be protected from moisture. A sophisticated design is required to achieve this goal because of the fact that, in such an appliance, an externally exposed part, e.g. a switching member, is required to move relative to another part which is disposed in the interior portion of said appliance. As conventional devices are not very successful in dealing with this problem, it is still desirable to develop a flashlight, the interior of which can effectively be protected from moisture.

SUMMARY OF THE INVENTION

It is a main object of the present invention to provide a improvement of a switching device which is easy to assemble and which can prevent the intrusion of moisture thereinto.

In accordance with the present invention, a switching device having a waterproof structure according to the present invention comprises:

a switching body adapted for providing electric contact for said electric appliance, including an outer peripheral wall of a dimension which is the same as or slightly larger than that of a space defined by a inner wall of said circumferential shell;

a button movably disposed on said switching body;

a sealing member including an edge portion thereof which is interposed between said switching body and a inner surface of a peripheral portion of said opening so as to prevent the intrusion of moisture into said cavity; and a coupling ring disposed between the switching body and the circumferential shell to strengthen the engagement of the switching body with the hollow body;

wherein said switching body includes a first and a second part, each of which has a complementary sectioned profile, said profile constituting a sloping plane inclined longitudinally relative to an axis of a direction of said switching body without abutting the circumferential shell.

In a preferred embodiment, one of said parts includes the switching element and the other merely forming a hollow housing to enable the appliance to be easily assembled.

In one aspect of the present invention, the coupling ring is provided to further secure the switching body on the hollow body of the electric appliance.

In another aspect of the present invention, the sloping plane provides a easy combination and an exact securing of the sealing member when the two parts of the switching body are respectively positioned into the hollow body.

In still another aspect of the present invention, the sealing member is formed of flexible material.

BRIEF DESCRIPTION OF THE DRAWINGS

The invention will be further described by way of example with reference to the accompanying drawings, in which:

FIG. 2 is a perspective view of a switching body combined with a lamp socket assembly in accordance with the present invention.

FIG. 3 is a sectional view of an embodiment of a switching device with a waterproof structure in accordance with the present invention.

DETAILED DESCRIPTION OF A PREFERRED EMBODIMENT

Figure 1:
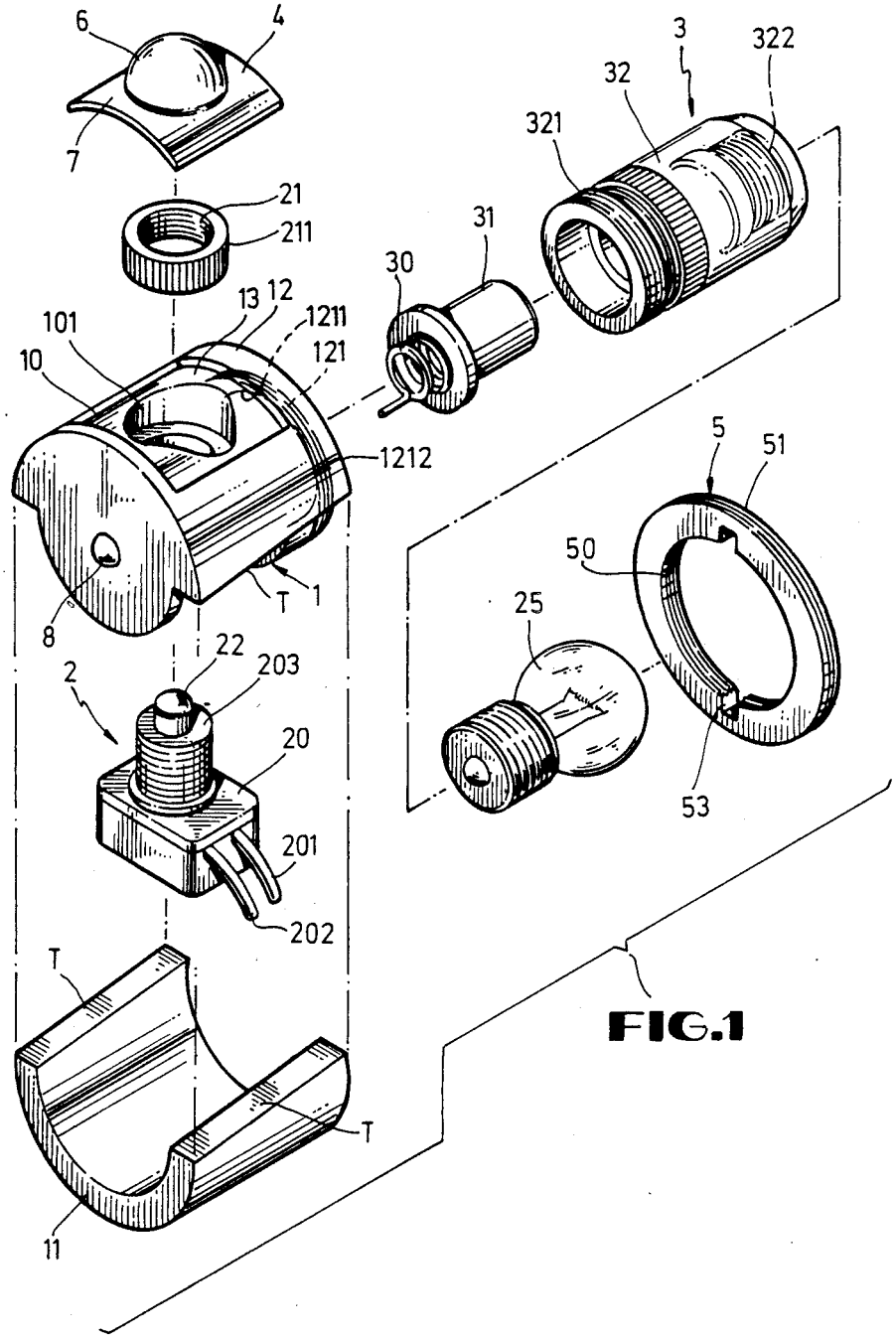
FIG. 1 is an exploded perspective view of an embodiment of a switching body with a waterproof structure in accordance with the present invention.

As shown in FIG. 1, a switching device of a waterproof flashlight in accordance with the present invention comprises a cylindrical body 1; a sealing member 4 and a coupling ring 5. Cylindrical body 1 includes a first part 10 and a second part 11, each of the two parts 10, 11 having a complementary sectioned profile, T, the profile constituting a sloping plane which is inclined longitudinally relative to an axis of said cylindrical body. The first part 10 is provided with a seat defined by a passage 101 for receiving and securing an electric element. Also, 2 in first part 10 a round flange 121 is formed on the side surface 12 thereof, the inner 1211 and outer surface 1212 of which are threaded. The first part 10 is further provided with a protrusion 8 on another side surface thereof for providing better contact with the electrode of a battery (not shown).

The electric element 2 includes an element body 20 having a threaded protrusion 203, a slideable button 22 mounted in element body 20 and at least two connecting wires 201, 202. The threaded protrusion 203 of element body 20 can pass through the entire length of the passage 101 to be engaged with a ring 211 having a inner thread 21.

The sealing member 4 is provided with a semi-spherical projection 6 for receiving the slideable button 22 when sealing member 4 is placed onto the outside surface of the first part 10 of the switching body, and an edge portion 7 has a thickness which is greater than the depth of a recess 13 formed on the outside surface of the first part 10. The profile of the edge portion of the sealing member 4 is attached onto the periphery of the recess 13.

The coupling ring 5 which is threaded on the inner 50 and outer 51 surfaces thereof is respectively engaged with threaded surfaces 1211 of the switching body and the circumferential shell 9 as shown in FIG. 3. On the inner surface 50 of the coupling ring 5 are provided two diametrically opposite notches 53 for facilitating the screwing of said coupling ring 5 onto the threaded portion of the switching body.

As also shown in FIG. 1, there is a lamp socket assembly 3 which includes a compression spring 30, an envelope 31, a lamp socket 32 and a lamp 25. The lamp socket 32 is provided with a passage which receives the lamp 25 and the envelope 31, threads 322 formed on the inner surface of side of said passage for engaging with those of the lamp, and threads 321 formed on the surface of the another side thereof for engaging with the threads 1212 of switching body 1. The compression spring 30 is positioned within the envelope 31 and is connected with the contact of the lamp.

FIG. 2 illustrates a combination of said switching body and said lamp socket assembly. FIG. 3 illustrates an embodiment of a combination of the switching device with the electric appliance in accordance with the present invention. In FIG. 3, the combination of the switching body provided with the lamp socket assembly and the sealing member is provided in the cavity of the circumferential shell 9 which is formed as a hollow body of a flashlight 26. It is noted that the inner circumferential surface of the hollow body of this portable electric appliance has an annular flange 55 which is threaded so as to engage with the outside threads 51 of the coupling ring 5. The combination of all the members of said device is clearly shown in the illustration. To assemble the device as shown in FIG. 3, sealing member 4 is attached to first part 10, which is put into circumferential shell 9. Second part 11 is then inserted as a wedge between first part 10, with their complementary profiles aligned, and circumferential shell 9. Thus, as shown in FIG. 3, the outer surface of first part 10 and ring 211 compress sealing member 4 against the circumferential shell 9, creating a tight seal. Upon utilizing the switching device of this invention within an electric appliance, a completely waterproof nature for a device of this invention is secured.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the appended claims.

I claim:

1. A water resistant switching apparatus for an electric appliance having a circumferential shell defining a cavity containing electrical components to be protected from moisture, the circumferential shell having an opening allowing access to the cavity, the switching apparatus comprising:

a body having at least two parts having complementary sectioned profiles constituting sloping planes inclined longitudinally relative to an axis of the circumferential shell, the sloping planes on the two parts of the body having a conforming sloping relationship so that the two parts of the body sealingly engage each other, the body being disposed within the circumferential shell at the opening in the circumferential shell, the body including an outer peripheral wall having a circumferential dimension which is not substantially smaller than that of a space defined by an inner wall of the circumferential shell, the circumferential dimension of the outer peripheral wall of the body being adjustable by sliding one part of the body longitudinally with respect to the other part of the body, the first part of the body having a passage for allowing access to an electrical switching element;

an electrical switching element disposed in the body so that it can be actuated through the passage in the first part of the body, the electrical switching element having a movable surface for actuating the electrical switching element; and a sealing member covering the passage in the first part of the body and including an edge portion thereof which is interposed between the first part of the body and the inner wall of the circumferential shell, and covering said opening, the two parts of the body being disposed longitudinally with respect to each other so that the circumferential dimension of the outer peripheral wall of the body expands to sealingly engage the outer peripheral wall of the body with the inner wall of the circumferential shell, and to urge the first part of the body into sealing engagement with the edge portion of the sealing member, thereby compressing the sealing member between the first part of the body and the inner wall of the circumferential shell to effect a tight seal, so as to prevent an intrusion of moisture into the cavity.

2. The switching apparatus as claimed in claim 1, wherein said electrical switching element passes through said passage in the first part of the body and projects outwardly to enable said movable surface of the electrical switching element to be pressed by a user of the appliance.

3. The switching apparatus as claimed in claim 1, wherein said electrical switching element is adapted for connecting to a power source and a lamp socket assembly for controlling the operation of the electrical appliance.

4. The switching apparatus as claimed in claim 1, wherein said sealing member is formed of a flexible material and is provided with a semi-spherical projection for receiving said movable surface of the electrical switching element.

5. A switching apparatus for a portable electric appliance which has a housing defining a cavity, the housing having an opening allowing access into the cavity of the portable electrical appliance, the switching apparatus comprising:

a generally cylindrically shaped body disposed in the housing at the opening in the housing, the body having an outer peripheral wall which is disposed against an inner wall of the housing, the body having a first part in the shape of a segmented cylinder and a second part in the shape of a complementary segmented cylinder, the two parts having abutting surfaces comprising sloping planes inclined longitudinally relative to an axis of the body, the sloping planes on the two parts of the body having a conforming sloping relationship so that the two parts of the body sealingly engage each other, the circumference of the outer peripheral wall of the body being adjustable by sliding the first part of the body longitudinally with respect to the second part of the body;

a button movably disposed on an electrical switching element disposed within the body;

a sealing member including an edge portion thereof which is interposed between the first part of the body and a surface of the inner wall of the housing at the opening, the sealing member covering the opening, the two parts of the body being disposed longitudinally with respect to each other so that the circumference of the outer peripheral wall of the body expands to urge the outer peripheral wall of the body into sealing engagement with the inner wall of the housing, and to urge the first part of the body into sealing engagement with the edge portion of the sealing member, thereby compressing the sealing member between the first part of the body and the inner wall of the housing to effect a tight seal, so as to prevent an intrusion of moisture into the cavity; and a coupling ring disposed between the body and the housing, and being operative to engage the electrical switching element and urge it into engagement with the body to strengthen the engagement of the body with the electrical switching element.

6. The switching apparatus as claimed in claim 5, wherein said button passes through said opening and projects outwardly to enable said button to be pressed by a user of the appliance.

7. The switching apparatus as claimed in claim 5, wherein said electrical switching element is adapted for connecting to a power source and a lamp socket assembly for controlling the operation of the portable electric appliance.

8. The switching apparatus as claimed in claim 5, wherein said sealing member is formed of a flexible material and is provided with a semi-spherical projection for concealing said button.

9. A portable electrical appliance which comprises:

a generally cylindrical housing defining a cavity containing electrical components to be protected from moisture, the housing having an opening allowing access to the cavity from the outside of the portable electrical appliance, the housing including a round flange having inwardly projecting threads integrally formed on an inner surface thereof;

a body enclosing an electric switch for providing electric contact to the electric appliance, the body including an outer peripheral wall having a circumferential dimension which is not substantially smaller than that of a space defined by an inner wall of the housing, the body comprising at least two parts having complementary sectioned profiles constituting sloping planes inclined longitudinally relative to an axis of the housing, the sloping planes on the two parts of the body having a conforming sloping relationship so that the two parts of the body sealingly engage each other, the body being disposed within the housing at the opening in the housing;

a button movably disposed on the electric switch and being accessible through the opening in the housing;

a sealing member including an edge portion which is interposed between the first part of the body and an inner surface of a peripheral portion of the inner wall of the housing immediately adjacent the opening so as to prevent an intrusion of moisture into the cavity; and a coupling ring disposed between the body and the housing to strengthen the engagement of the body with the electric switch;

wherein the first part and second part of the body are positioned longitudinally relative to each other, so that the second part of the body wedges against the first part of the body, pressing the first part against the edge portion of the sealing member, and compressing the sealing member between the first part of the body and the inner wall of the housing to effect a tight seal.

10. The portable electric appliance as claimed in claim 9, wherein said body includes a ring flange provided at a side surface thereof and having a threaded inner and outer surface for respectively engaging with a lamp socket assembly and said coupling ring.

11. The portable electric appliance as claimed in claim 9, wherein said coupling ring includes a threaded annular inner and outer surface for respectively engaging with the body and the housing, and the annular inner surface thereof has two or more notches for facilitating the screwing of said coupling ring onto the threaded portion of the body.

* * * * *